US006493627B1

(12) United States Patent
Gallagher et al.

(10) Patent No.: US 6,493,627 B1
(45) Date of Patent: Dec. 10, 2002

(54) VARIABLE FUEL LIMIT FOR DIESEL ENGINE

(75) Inventors: Shawn M. Gallagher, Erie, PA (US); Eric R. Dillen, Erie, PA (US); Vincent F. Dunsworth, Edinboro, PA (US)

(73) Assignee: General Electric Company, Schenectady, NY (US)

( * ) Notice: Subject to any disclaimer, the term of this patent is extended or adjusted under 35 U.S.C. 154(b) by 44 days.

(21) Appl. No.: 09/669,999

(22) Filed: Sep. 25, 2000

(51) Int. Cl.[7] ..... F02M 59/20; F02D 41/30
(52) U.S. Cl. ..... 701/104; 123/480
(58) Field of Search ..... 701/104, 102, 701/103; 123/478, 479, 480, 501, 486, 488, 456, 497, 496

(56) References Cited

U.S. PATENT DOCUMENTS 4,364,351 A * 12/1982 Romblom et al. ..... 123/357
4,428,354 A * 1/1984 Sundeen et al. ..... 123/458
4,643,154 A * 2/1987 Matsuno et al. ..... 123/501
4,730,586 A * 3/1988 Yamaguchi et al. ..... 123/501
5,067,461 A * 11/1991 Joachim et al. ..... 123/479
5,411,002 A * 5/1995 Smitley ..... 123/497
5,740,783 A * 4/1998 Learman et al. ..... 123/497
5,826,563 A 10/1998 Patel et al.
5,901,683 A 5/1999 Patel

FOREIGN PATENT DOCUMENTS

DE 37 29 770 A1 * 3/1989 ..... F02D/41/14
DE 43 02 339 A1 * 1/1993 ..... F02D/41/02

* cited by examiner

*Primary Examiner*—Hieu T. Vo
(74) *Attorney, Agent, or Firm*—John L. DeAngelis, Jr.; Carl A. Rowold; Beusse Brownlee Bowdoin & Wolter, P.A.

(57) ABSTRACT

A diesel engine including a technique for limiting the fuel value injected into each cylinder so that overfueling does not occur. A fuel value limit is calculated based on ambient temperature and pressure, fuel temperature, fuel heating value and the conditions of the fuel pump and injector. This fuel value limit is compared to the actual fuel value commanded and if the limit is greater than the fuel value commanded, then the engine operation is derated. Alternatively, if the fuel value is below the calculated limit, then the engine can accept the fuel value without affecting its operation.

22 Claims, 4 Drawing Sheets

VARIABLE FUEL LIMIT FOR DIESEL ENGINE

BACKGROUND OF THE INVENTION

The invention relates generally to establishing a fuel value limit for diesel engines, and more specifically to establishing such a limit based on the ambient conditions in which the diesel engine operates.

Large self-propelled traction vehicles such as locomotives commonly use a diesel engine to drive an electrical transmission system comprising generating means for supplying electric current to a plurality of direct current traction motors whose rotors are drivingly coupled through speed-reducing gearing to the respective axle-wheel sets of the vehicle. The generating means typically comprises a main 3-phase traction alternator whose rotor is mechanically coupled to the output shaft of the engine, typically a 16-cylinder turbocharged diesel engine. When excitation current is supplied to field windings on the rotating rotor, alternating voltages are generated in the 3-phase stator windings of the alternator. These voltages are rectified and applied to the armature windings of the traction motors.

During the "motoring" or propulsion mode of operation, a locomotive diesel engine tends to deliver constant power from the traction alternator to the traction motors, depending on the throttle setting and ambient conditions, regardless of locomotive speed. For maximum performance, the electrical power output of the traction alternator must be suitably controlled so that the locomotive utilizes fall engine power. For proper train handling, intermediate power output levels are provided to permit graduation from minimum to fall output. But the traction alternator load on the engine must not exceed the level of power the engine is designed to develop for a given speed. Overloads can cause premature wear, engine stalling or "bogging," or other undesirable effects. Historically, locomotive control systems have been designed so that the operator can select the desired level of traction power, in discrete steps between zero and maximum, so that the traction and auxiliary alternator, driven by the engine, can supply the power demanded by the traction load and the auxiliary loads, respectively.

In the prior art locomotives, when the throttle is advanced from one position to the next (commonly referred to as notches) the diesel engine speed and the load (or excitation) applied to the traction motors are simultaneously increased to the next speed and horsepower point established for the new notch position. The engine acceleration to the new speed point is controlled by the electronic fuel injection controller which adjusts the quantity of pressurized diesel fuel (i.e., fuel oil) injected into each of the engine cylinders so that the actual speed (in rpm) of the crankshaft corresponds to a desired speed. The locomotive control system applies more excitation to the main alternator, which in turn supplies more current to the traction motors, increasing the motor horsepower.

In the prior art locomotive systems, the electronic fuel injection controller acts as the speed governor in response to speed changes requested by the locomotive control system. In the prior art, the speed governor does not receive any signals from the throttle when it is changed from one notch position to another and therefore does not know when a notch change has occurred; the speed governor knows only the speed demand as requested by the locomotive control system. In fact, there are multiple notch settings that vary the horsepower delivered by the traction motors without changing the engine speed.

For each of its eight different notch settings, the engine is capable of developing a corresponding constant amount of horsepower (assuming maximum output torque). When the throttle notch 8 is selected, maximum speed (e.g., 1,050 rpm) and maximum rated gross horsepower (e.g., 4,500) are realized. Under normal conditions, the engine power at each notch equals the power demanded by the electric propulsion system, which is supplied by the engine-driven traction alternator, plus the power consumed by the electrically driven auxiliary equipment.

The electronic fuel injection controller calculates the fuel mass required to maintain the desired engine speed, then converts this value to a pulse duration, through a series of look-up tables. The pulse duration determines the fuel mass that is injected into each cylinder, as measured in $mm^3$/injection. The pulse is input to the pump solenoids that control the injection of fuel into each cylinder. The leading edge of the pulse determines the start of fuel injection, and the pulse length determines the duration during which fuel is injected into the cylinder. The look-up tables provide the required duration of fuel injection (i.e., the pulse duration) as a function of engine speed, speed demand, and start of injection timing. Before the diesel engine is placed in service, the tables are empirically created based on calibration tests performed on a test stand, during which the fuel delivery quantity is measured, while varying fuel injector cam speed (which is a function of engine speed), the start of injection timing, and the pulse duration. The tables are necessarily based on the fuel temperature during the test and the fact that when the test is performed the fuel pumps and injectors are new. Thus, the actual fuel temperature and the fuel pump and injector integrity during the bench test serve as the calibration point for the look-up tables.

It is possible, but not practical, to perform a series of calibration tests at various fuel temperatures and fuel pump and injector conditions. That is, a first calibration test could be performed based on a first fuel temperature and fuel pump and injector conditions based on one year of wear. The second test could be based on the first fuel temperature and a fuel pump and injector condition based on two years of wear. In this way, a series of tables could be created for later use when the diesel engine is placed into service. The appropriate table would be consulted, as a function of fuel temperature and fuel pump/injector wear, to determine the pulse duration. As the fuel temperature changes or the fuel pumps and injectors wear, the appropriate table would be selected from among those available. However, it is well known that it is not practical to create nor store such a large number of tables. Therefore, the prior art has developed certain techniques for determining the fuel value when actual conditions are different from those conditions extant when the calibration tests were conducted. It is known that under changed conditions of fuel temperature and fuel pump and injector wear, a different fuel value (i.e., a different pulse duration) must be commanded to inject the same fuel mass into each cylinder so that the engine speed under the current conditions equals the engine speed during the calibration tests. Another recognized disadvantage of the prior art scheme is the fact that the tables are generic and that one table is used for all engines in the same engine family. Thus subtle variations between individual diesel engines are not accounted for in the fuel tables.

There is a fuel value limit (expressed in $mm^3$/injection) associated with a diesel engine. This limit represents the maximum amount of fuel that can be injected into each cylinder without raising the cylinder pressure above its design value or causing excessive smoke. When the fuel injection controller commands a fuel value at the fuel limit, the diesel engine is derated (i.e., the engine cannot deliver more horsepower) and higher fuel values are prohibited by the controller. For example, assume that a fuel mass of 80 pounds must be injected into each cylinder, per hour, to maintain an engine speed of 1050 rpm at 4500 hp. Using the look-up tables, the electronic fuel injection controller generates a pulse having a duration such that a fuel volume of 1400 $mm^3$ is injected into each cylinder per stroke, to maintain this speed. Now, if the fuel temperature increases by 20° F., the fuel density decreases and thus a greater fuel volume must be injected during each injection so that the fuel mass remains unchanged and thus the same engine speed is maintained. The fuel injection controller uses a feedback loop to sense the speed decrease when the fuel density decreases and in response, using the tables, injects a greater fuel volume (i.e., 1415 $mm^3$/injection) to maintain the engine speed at 1050 rpm. Note that the injected fuel volume, as seen by the fuel injection controller, has increased from 1400 $mm^3$/injection to 1415 $mm^3$/injection, but the fuel mass has remained unchanged at 80 pounds per hour. In the prior art fuel systems, the fuel value limit is not changed when the fuel temperature increases, so that in the example above, the headroom between the fuel value and the fuel value limit decreased when the fuel value was increased from 1400 to 1415 $mm^3$/injection. But, in fact, the same mass of fuel was injected in each case.

In the prior art, mechanically operated fuel injection pumps are controlled by cam driven lifters for injecting the fuel through a nozzle into the combustion chamber. The pump is manually set to avoid injecting excessive fuel (i.e., prevent overfueling) into the cylinder by the position of a set screw, which can be adjusted to decrease or increase the amount of fuel injected. Typically, the set screw is adjusted so there is approximately a 1 percent fuel value margin. Assuming a fuel value (volume) of 1300 $mm^3$/stroke for steady-state operation, the fuel value can increase to approximately 1313 $mm^3$/stroke to meet engine load demands. The engine cannot respond to requests to increase speed or horsepower beyond that which can be provided by a fuel value limit of 1313 $mm^3$/stroke. As a result, the engine is derated when this fuel value is reached. Because this prior art fuel value limit system is mechanically controlled, its accuracy is limited by the tolerance associated with the mechanical components, and under certain conditions it unnecessarily limits the fuel value that can be provided to each cylinder without causing overfueling.

In addition to an increase in fuel temperature (which, as discussed above, can be caused by an increase in ambient temperature or an increase in the bulk temperature of the fuel), there are other conditions that require a higher fuel demand per injection to maintain the engine speed. In each case, the amount of energy derived from each fuel injection is the same (as it must be to maintain engine speed) but due to a condition associated with combustion efficiency, a greater quantity (volume) of fuel must be injected (i.e., longer pulse duration) to deliver the same speed and load. If ambient pressure decreases (the locomotive is climbing to a higher altitude), combustion becomes less efficient. Under these conditions, more fuel volume must be delivered during each injection to make up for the lost efficiency and increase in overall fuel consumption and thereby maintain engine speed. A similar decrease in efficiency occurs as the ambient air temperature goes up. Higher ambient air temperature conditions will also require more fuel to be delivered during each injection to maintain the same engine speed.

Another condition that will change the amount of fuel required to maintain engine speed is the amount of energy each fuel injection can provide. In this case, as the amount of energy derivable from a given fuel mass changes, the fuel injection quantity must change to deliver the same total energy to the cylinder and to deliver the same speed and horsepower. If the locomotive takes on a new load of fuel with lower heating value, longer injection durations (providing a greater fuel injection volume) are required to deliver the same amount of energy. The quantity of energy provided by the injected fuel from the new fuel load does not change, but the mass of injected fuel must change so that the energy content can remain the same. Because the energy delivered is unchanged, there is no increase in cylinder pressure. Thus, the fuel value limit, which is established based on the baseline conditions present when the fuel tables were created, does not accurately represent the actual fuel limit that will cause cylinder and engine damage.

Large diesel engines with electronic fuel injection in locomotive applications have considerable flexibility to impact the engine performance through the fuel injection system. For example, when a problem in the cylinder occurs that causes the cylinder to produce low power or no power, the other cylinders can make up for the lost power by the injection of additional fuel into the operating cylinders. Under certain conditions, such as a cold ambient temperature and low altitude, this could drive the operating cylinders into an overfueling condition where each cylinder is running at a higher power than its design capabilities. This higher power increases cylinder pressure, which can then adversely affect the cylinder and other engine components. To avoid the overfueling problem, the fuel injection controller sets a limit on the fuel value that can be delivered to each cylinder. The fuel limit is calculated by the software of the fuel injection controller as a function of engine speed and intake manifold air density. Specifically, in one prior art embodiment, there are two tables from which the fuel value limit is determined. The first table is one-dimensional, listing fuel value limits for each value of engine speed in 50 RPM increments. The second table is two-dimensional where the fuel value limit is a function of both intake manifold air density and engine speed. The intake manifold air density is calculated from the absolute manifold air pressure and manifold temperature. Each speed/manifold air density pair has a corresponding fuel value limit. The two dimensional table is used primarily to control engine smoke in those situations where a lower quantity of air is available. For instance, high altitude, high manifold air temperature, low manifold air pressure, and a transient situation all result in a lower quantity of air available for combustion. The lower fuel value limit between the two tables at any given condition is the limit used by the fuel injection controller. Generally, the results from the one dimensional table are lower than the two-dimensional table during normal steady state operation.

In one embodiment, the maximum fuel value limit from the first table above is set at approximately 6 percent above the standard fuel value. This value represents a compromise between setting a lower fuel value limit that will produce nuisance derating, and recognition of the fact that certain physical and energy conditions of the fuel (as discussed above) raise the fuel value required to meet the speed demand. In one embodiment, the value obtained from the one dimensional table allows the fuel value to increase to a maximum of 6 percent above its nominal value. The 6 percent was chosen to allow for some high altitude, warm ambient and warm fuel operating conditions. A negative effect to a fixed fuel value limit is its inability to effectively deal with the variety of ambient and external conditions to which the locomotive is subjected. For example, when a single cylinder becomes inoperative, the fuel value must be increased by approximately 6 percent to make up for the lost power. The additional fuel injected into each cylinder, up to the point where the 6 percent fuel value limit is reached, can overcome a loss of a single cylinder. (Each cylinder develops approximately 6 percent of the engine horsepower in a 16 cylinder engine.) However, if two cylinders become inoperative, then approximately 12 percent of the engine power has been lost. Since the fuel value limit is only 6 percent over normal, the engine cannot continue to deliver the same power when two cylinders are inoperative (at standard operating conditions). When the fuel limit is reached, the engine controller sends a signal to the locomotive controller to derate the allowable load on the engine, since that load value cannot be provided. As a result, using the 6 percent fuel value limit, it takes a loss of two cylinders to cause a power deration. For optimum engine protection, it may be desirable to derate when only one cylinder is lost but the 6 percent fixed fuel value limit cannot accommodate this. As will be shown below in conjunction with the teachings of the present invention, if ambient conditions are forcing low fuel values, for example, a cold day with operation at low altitude, there may, in fact, be sufficient fuel margin to the fuel limit where overfueling would occur so that the engine could deliver full load with two cylinders inoperable. But the prior art fixed fuel limit does not accommodate this possibility.

BRIEF SUMMARY OF THE INVENTION

The present invention provides a method and system for more effectively, adaptively, and accurately setting the fuel value limit based on ambient conditions, in particular based on the ambient air temperature and pressure, the fuel temperature, the fuel heating value, and the fuel pump and injector wear. By more accurately determining the fuel value limit that will cause engine overfueling based on these operating conditions, the maximum fuel value is raised and the occurrences of engine derating are correspondingly reduced. Overfueling refers to that condition where an excessive amount of fuel is injected into each cylinder, causing the cylinder to run above its rated power. As a result, the cylinder pressure is increased above its rated value, potentially causing adverse affects on the engine and related components. The present invention provides for the determination of a tighter and more accurate fuel value limit, so that overloading the cylinders is a less likely occurrence. Advantageously, adapting the fuel value limit to the actual operating conditions avoids nuisance derating of the locomotive.

BRIEF DESCRIPTION OF THE DRAWINGS

For a better understanding of the present invention, reference may be made to the following detailed description, taken in conjunction with the accompanying drawings in which.

DETAILED DESCRIPTION OF THE PREFERRED EMBODIMENTS

Figure 1:
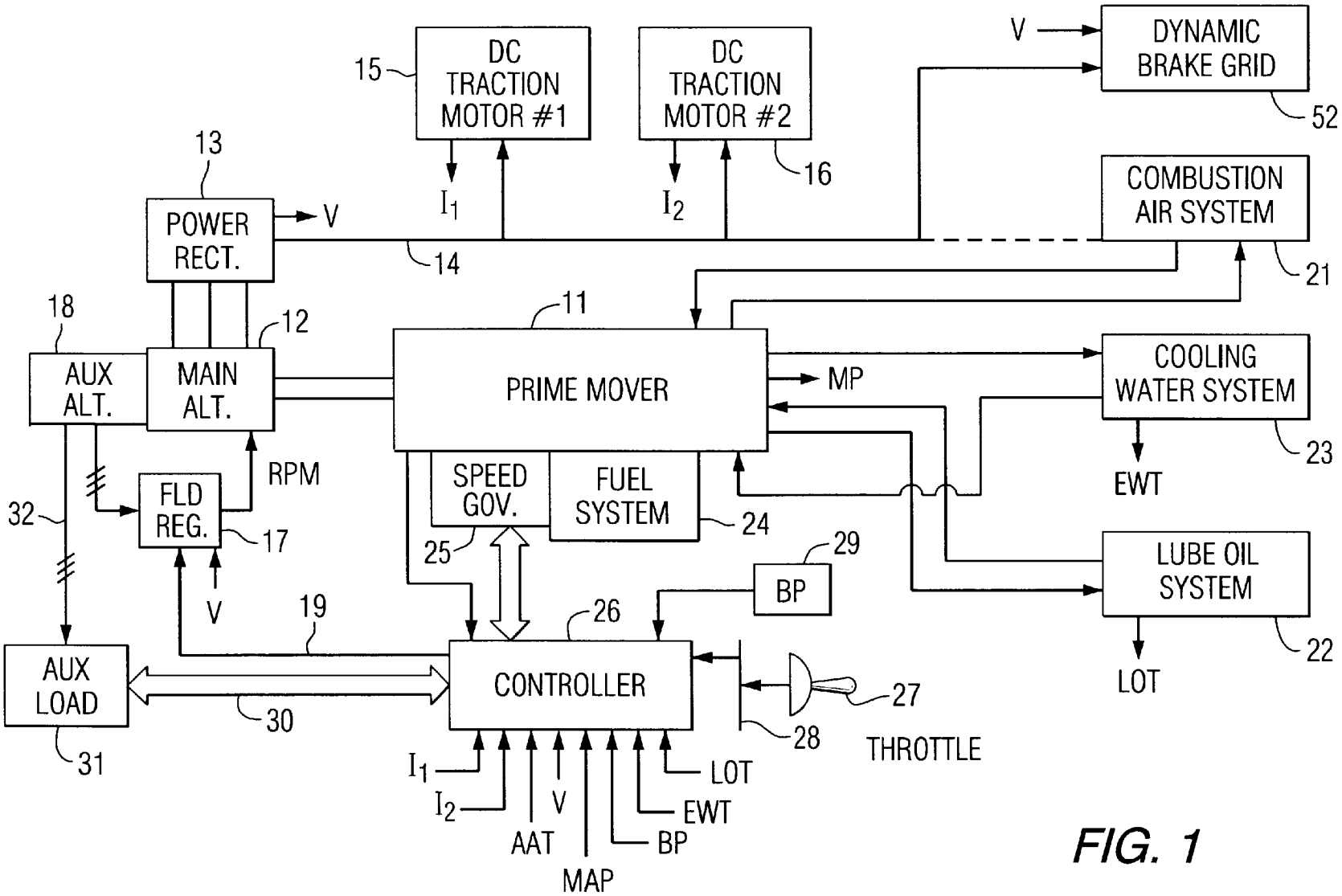
FIG. 1 is a schematic diagram of the principal components of a locomotive system.

Before describing in detail the particular scheme for determining a fuel value limit in accordance with the present invention, it should be observed that the present invention resides primarily in a novel combination of processing steps and hardware related to a method and apparatus for determining a fuel value limit. Accordingly, these processing steps and hardware components have been represented by conventional processes and elements in the drawings, showing only those specific details that are pertinent to the present invention so as not to obscure the disclosure with structural details that will be readily apparent to those skilled in the art having the benefit of the description herein.

Referring now to FIG. 1, there is shown a simplified functional block diagram of a locomotive propulsion system including a variable speed prime mover 11 mechanically coupled to drive a three-phase alternating current (AC) synchronous alternator 12, also referred to as a main traction alternator. The three-phase voltages generated by the alternator 12 are applied to AC input terminals of at least one three-phase, bi-directional uncontrolled power rectifier bridge 13. In the illustrated system, the locomotive utilizes DC traction motors 15 and 16 for driving the wheels of the locomotive. In such a case, the rectified electric power output of the bridge 13 is supplied via a DC bus 14 to the parallel connected armature windings of the traction motors 15, 16. While only two motors, 15 and 16 are shown, in practice, a traction motor is supplied for each axle of a locomotive and there are typically two to three axles per truck with two trucks per locomotive so that a conventional locomotive may have from four to six traction motors. If the traction motors are AC rather than DC motors, a controlled inverter (not shown) is interposed on the DC bus 14 to supply variable frequency power to the AC motors.

The prime mover 11 is a thermal or internal combustion engine and is typically a high horsepower, turbocharged, four stroke, 16 cylinder diesel engine. Such an engine has a number of ancillary systems that are represented by the labeled blocks in FIG. 1. A combustion air system 21 conventionally includes an engine exhaust gas driven turbocharger for compressing air in the combustion air intake manifold of the engine. A lube oil system 22 conventionally includes an engine crankshaft driven pump and associated piping for supplying suitable lubricating oil to the various moving parts of the engine. A cooling water system 23 conventionally includes a pump for circulating relatively cool water from a plurality of air cooled heat exchangers or radiators to a lube oil cooler, to the cylinder liners of the engine for absorbing heat rejected during the combustion process, and also to intercoolers through which the combustion air passes after being compressed by the turbocharger. Still further, the diesel engine includes a fuel system 24 comprising a fuel tank, fuel pumps and nozzles for injecting fuel oil into the respective power cylinders which are arranged in two rows or banks on opposite sides of the engine. Tappet rods cooperate with fuel cams on a pair of camshafts for actuating the respective fuel injectors at the proper times during each full turn of the engine camshaft. The electronic fuel injector controller then controls start of and duration of fuel flow into a cylinder each time the associated injector is actuated. The excitation of each fuel pump solenoid, and hence the quantity of fuel that is being supplied to the engine, is controlled by output signals from the engine speed governor 25. The governor regulates engine speed by automatically controlling fuel flow within predetermined fuel value limits in a direction and by an amount that minimizes any difference between actual and desired speeds of the engine crankshaft. The desired speed is set by a variable speed control signal received from a controller 26, which signal is herein called a speed command signal or speed call signal.

In a normal motoring or propulsion mode of operation, the value of the engine speed call signal provided by the controller 26 is determined by the position of a handle 27 of a manually operated throttle to which the controller is coupled. A locomotive throttle conventionally has eight power positions or notches (N), plus an idle position. N1 corresponds to the minimum desired engine speed or power, while N8 corresponds to maximum speed and full power. In a consist of two or more locomotives, only the lead unit is usually attended and the controller on board each trailing unit receives, over a train line 28, a signal that indicates the throttle position selected by the operator in the lead unit.

For each power level of the engine there is a corresponding desired load. The controller 26 is arranged to translate the throttle notch information into a control signal of appropriate magnitude on the input line 19 of the alternator field regulator 17, whereby the traction power is regulated to match the called-for power, so long as the alternator output voltage and load current are both within predetermined limits. For this purpose, it is necessary to supply the controller 26 with information about various operating conditions and parameters of the propulsion system, including the engine and its support systems. More particularly, the governor 26 typically receives voltage and current feedback signals representative of the power supplied to the traction motors and a load control signal issued by the governor system 25 if the engine cannot develop the power demanded and still maintain the called-for speed. The controller also receives an engine speed signal (in RPM) indicating the rotational speed of the engine crankshaft and ambient air pressure signal (BP) from a barometric pressure sensor 29, an intake manifold air pressure signal (MAP) from a pressure sensor associated with an air intake manifold at the engine, an oil temperature signal (LOT) from a temperature sensor on the hot oil side of the lube oil cooler, a water temperature signal (EWT) from a temperature sensor in a hot water section of the cooling water system 23 and an ambient air temperature signal (AAT) from an appropriate temperature sensor. The controller uses the signal EWT to control radiator fan motors that control the flow of air across the heat exchange tubes of the radiators to maintain a relatively constant engine operating temperature over the load range of the engine and with wide variations in ambient temperature.

The above listing is representative of the signals that are applied to the controller 26 to enable the controller to properly send the speed command to the governor 25 and to regulate the power output of the engine to meet the requirements of the locomotive and any auxiliary equipment coupled to the locomotive. While each cylinder of the engine has its own individually controllable fuel injector, typical operation of the engine is to supply the same control signal from the engine speed governor 25 to each fuel injector such that the amount of fuel injected into each cylinder of the engine is the same.

Each notch position of the throttle 27 commands a specific engine speed (and locomotive horsepower request), which is translated into a specific fuel value to deliver the requested engine speed. But certain ambient conditions, such as fuel temperature, fuel heating value, and the physical condition of the fuel injection hardware, effect the amount of fuel (i.e., the fuel value) required to deliver the commanded speed. When engine operating conditions stack up to raise the required fuel value (i.e., higher ambient temperature and pressure, hot fuel, and worn fuel injection pumps) then the margin to the fuel value limit decreases. Under these conditions, if additional fuel is required to meet engine speed or horsepower demands, the fuel value limit is more likely to be reached, at which point the engine must be derated. But, in fact, under these conditions, this fuel value limit does not represent the quantity of fuel that if injected into each cylinder would cause overfueling. The fuel value limit that will cause overfueling is in fact higher than the fuel value limit established by the prior art methods. The present invention takes these operating conditions into consideration when establishing the fuel value limit. Similarly, when engine operating conditions and ambient conditions aggregate to lower the fuel value required to meet the commanded engine speed, then there is excessive margin to the fuel value limit. For instance, under the conditions of cold ambient temperature, cold fuel, and new fuel injection pumps, less fuel is required to meet the commanded speed. Therefore, the margin between the fuel value and the fuel value limit is too great. In fact, engine overfueling will occur at a fuel value lower than the fuel value limit. Under these conditions, the engine could actually run at full power with several inoperable cylinders, reducing engine life.

Figure 2:
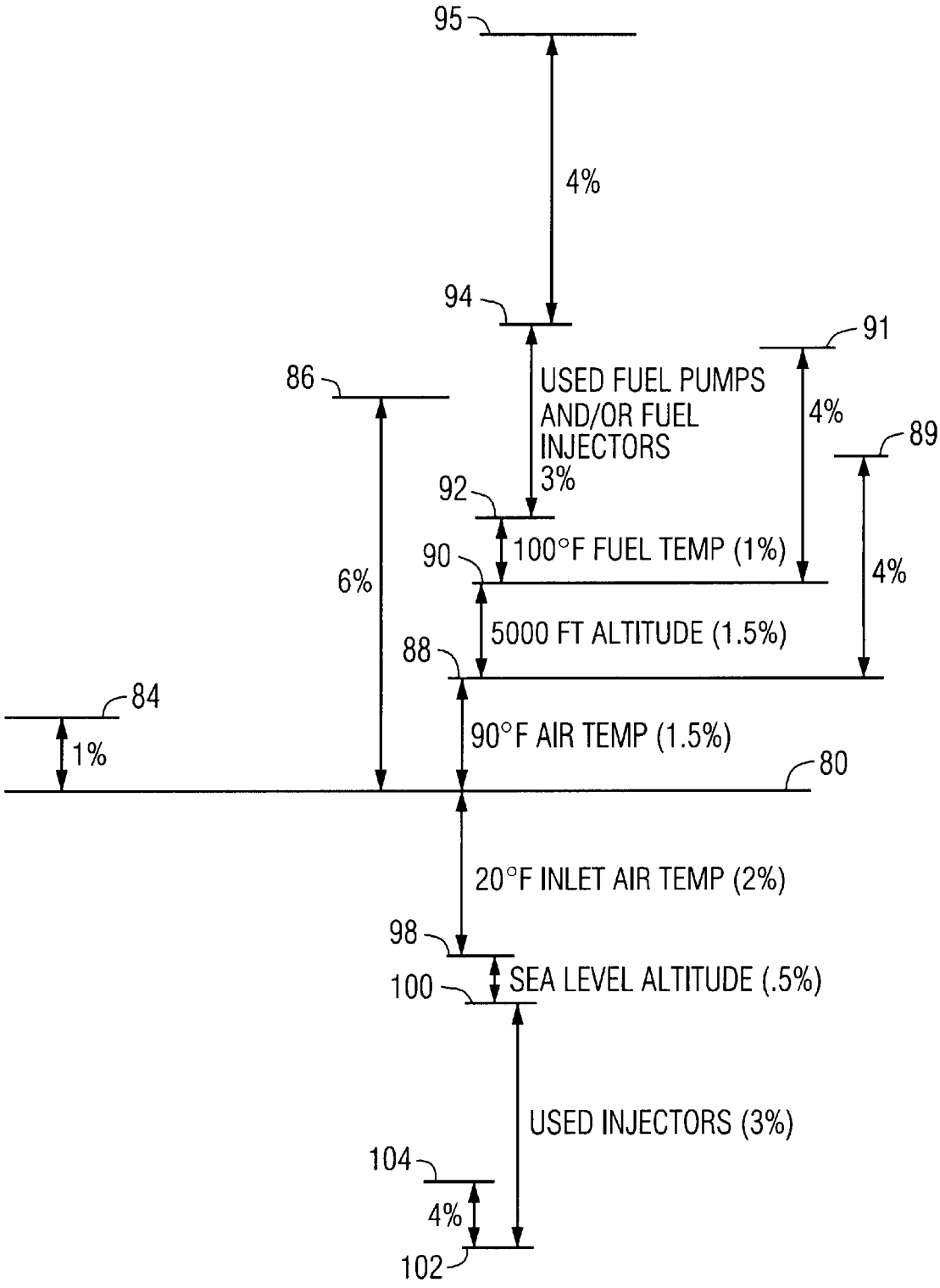
FIG. 2 is a line graph illustrating the determination of a fuel value limit in accord with the present invention.

Turning to FIG. 2, there is shown a chart illustrating the process of setting a fuel value limit in accord with the present invention. A fuel value at standard conditions is represented by reference character 80. The fuel value 80 represents the typical amount of fuel that must be injected into each cylinder at the notch 8 position (1050 rpm engine speed) with a fuel temperature of 80° F., an air temperature of 60° F. at the turbocharger inlet, operation at a 1,000 feet altitude, new fuel injection equipment and fuel with a constant and typical heating value and specific gravity. In one embodiment, the fuel value represented by the reference character 80 is 1300 $mm^3$/stroke. Reference character 84 represents the fuel value limit of approximately 1 percent as set by the mechanical fuel injection systems of the prior art. With this 1 percent fuel injection limit, nuisance derating under various operating and ambient conditions is likely, as such conditions may require the injection of a fuel value greater than fuel value limit 84 to maintain engine speed. The fuel value limit 84 will also very likely cause engine derating if one cylinder becomes inoperable.

Reference character 86 represents a 6 percent maximum fuel value limit. As discussed in the Background section above, the prior art technique for setting the fuel value limit is a function of engine speed and the intake manifold air density (which is a function of the temperature and pressure of the ambient air). This prior art technique represents an attempt to give some consideration to certain engine operating variations, while maintaining a fixed fuel limit. This 6 percent margin eliminates some nuisance derating under various operating and ambient conditions. It may not cause engine derating with two cylinders inoperable, depending upon the operating and ambient conditions, when in fact the engine is overfueling.

The fuel values shown on the right side of FIG. 2 illustrate a more accurate fuel value limit based on the teachings of the present invention. Beyond the increased fuel values caused by the various conditions, as illustrated by the reference characters 88, 90, 92, and 94 in FIG. 2, there is an additional 4 percent margin that floats on top of each of these operating conditions (whenever the conditions occur singularly or one or more in combination). This additional margin can take on other values in other embodiments of the present invention, as can be appreciated by those skilled in the art. In another embodiment, the margin value can be a function of a measured value (i.e. greater or lessor margin based on altitude or if the locomotive is operating above or below standard conditions). The 4 percent margin value will provide some engine derating with one cylinder out under standard operating conditions.

As discussed above, each of these conditions requires the delivery of a greater fuel volume, but do not bring the engine any closer to an overfueled condition because the greater fuel volume is required to deliver the same amount of energy (where the amount of energy is determined by the fuel mass) as the fuel volume required under ambient conditions. If, for example, the air inlet temperature is 90° F. (instead of 60° F. baseline used to establish the fuel value look-up tables) then the diesel engine requires additional injected fuel volume to maintain the same engine speed at 60° F. At an air temperature of 90° F., (see reference character 88) the fuel value increases by 1.5 percent to compensate for the higher air inlet temperatures, and an additional 4 percent overhead margin is added before the engine reaches an overfueled state and is derated. Thus, the fuel limit is identified by reference character 89.

The margin identified by reference character 90 assumes that the diesel engine is operating at an altitude of 5000 feet and the air inlet temperature is 90° F. Operation at this altitude would normally take away a 1.5 percent in margin to the fuel limit or, stated differently, requires an additional 1.5 percent fuel value to deliver the same energy as operation at 1000 ft altitude. To this point, a 3.0 percent increase in fuel value has been imposed, due to an increased air inlet temperature and operation at a higher altitude, and the 4 percent fuel value limit margin is added above the reference character 90. See reference character 91.

Assume that the fuel temperature is 100° F., instead of the standard temperature of 80° F. This condition would normally add another 1.0 percent of lost margin to the fuel value limit. Fuel temperature is inversely proportional to density, so more fuel volume is required to produce the same energy at hotter fuel temperatures. See reference character 92. The 4 percent margin is added to reference character 92, so that the fuel value can increase by 4 percent, if required to meet an increase in engine speed demand. Finally, assume that the engine fuel pumps and/or the fuel injectors have worn to the extent that the controller needs to command an additional 3 percent of fuel to inject the same quantity of fuel to maintain engine speed. This margin is illustrated by a reference character 94 in FIG. 2. It should be noted that the operational parameters of 90° F. inlet air temperature, 100° F. fuel temperature, and operation at a 5,000 feet altitude could represent typical conditions to be experienced by a diesel locomotive in the summer in Denver, Colo. Assuming all the operating conditions shown in FIG. 2 are present, the reference character 94 represents the fuel value that takes into account all these conditions. A 4 percent fuel value margin is now added to the fuel value to set the fuel value limit, as indicated by reference character 95. The fuel value at the reference character 95 represents the fuel limit, over and above the quantity of fuel required for the set of operating conditions set forth in FIG. 2. The fuel value margin can be chosen as a function of one or more of the operating or ambient conditions or selected by the locomotive operator. In some situations, even a margin of 0 percent may be appropriate.

The present invention eliminates nuisance derating because the various operating and ambient conditions have already been accounted for in setting the new fuel value limit. If the fuel margin is set at 6 percent (rather than 4 percent as shown in the embodiment of FIG. 2), the engine can continue to function without derating should one cylinder fail. Note that given the operating conditions set forth in FIG. 2, both prior art techniques setting a fuel value limit 84 or 86 would require engine derating, as these prior art fuel value limits are fixed, because they do not take into account any changed operating conditions.

If the ambient conditions move in the other direction, for example, an inlet air temperature of 20° F., operation at sea level, and worn injectors, then the expected fuel value changes are illustrated by reference characters 98, 100, and 102, respectively. Each of these operating/ambient condition changes requires a smaller fuel value compared with the nominal value designated by the reference character 80, to a new value designated by the reference character 102. The locomotive typically includes a fuel heater that warms the fuel to 80° F.; therefore a fuel temperature below 80° F. is not a factor in the fuel limit calculation. The fuel value limit of 4 percent is added to set the fuel limit at the level designated by a reference character 104. Note there is an 11.5 percent margin between the fuel value at the reference character 102 and the fuel value at the reference character 86. Since the loss of two cylinders represents the loss of approximately 12 percent of the engine power, an increase in fuel value of approximately 12 percent allows the engine to continue supplying the same load output. But, injecting more than a 12 percent increase in fuel value into each cylinder causes cylinder over pressure and excess wear of cylinder and engine components.

Figure 3:
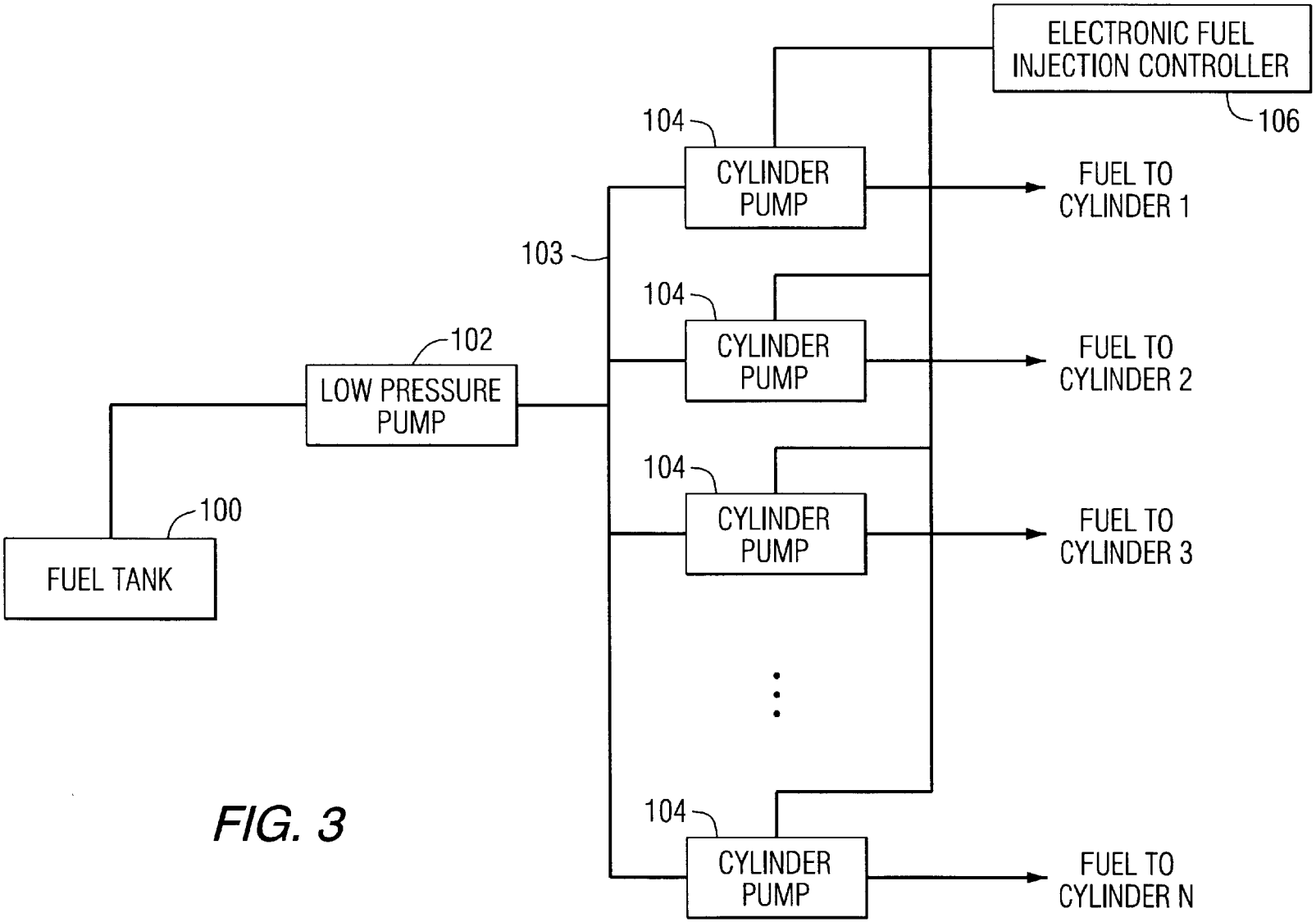
FIG. 3 is a block diagram of the fuel system of the locomotive illustrated in FIG. 1.

FIG. 3 is a block diagram showing the essential components of the diesel engine fuel system. A low pressure pump 102 draws fuel from a fuel tank 100. n cylinder pumps 104 (where n equals the number of cylinders in the diesel engine) draw fuel from the low pressure fuel rail 103 and inject it, at a high pressure, into the cylinder associated with each cylinder pump 104. Operation of the cylinder pumps 104 are controlled by an electronic fuel injection controller 106. In one embodiment, the electronic fuel injection controller 106 is a component of the controller 25 illustrated in FIG. 1. Each cylinder pump 104 includes a solenoid operated by the electronic fuel injection controller 106 for controlling injection of the fuel into the cylinder. Upon the start of fuel injection, the electronic fuel injection controller 106 sends a signal to activate the solenoid associated with the specific cylinder to be ignited. When the electronic fuel injection controller 106 determines that the predetermined duration for fuel injection has expired, the signal is removed and in response thereto the solenoid is deactivated, at which point the fuel injection process terminates. Typically the signal is a pulse where the leading edge starts fuel injection and the lagging edge stops fuel injection. The pulse duration represents the time during which fuel is injected. The process repeats itself during each compression stroke for each cylinder. The duration of the pulse is determined from look-up tables that use speed, fuel demand, and timing advance angle as inputs. The period of fuel injection must be controlled so that it does not inject a quantity of fuel above the maximum fuel value, as determined by the present invention as set forth herein.

The features of the present invention wherein the fuel value limit is modified based on ambient conditions, is carried out within the electronic fuel injection controller 106. In one embodiment, the electronic fuel injection controller 106 includes a microprocessor and supporting components. The electronic fuel injection controller 106 is responsive to signals representing the ambient temperature and pressure, the fuel temperature, fuel heating value and the amount of fuel injector pump wear to calculate the new fuel value limit. The amount of fuel injected per injection stroke is controlled in accord with the teachings of the present invention so as not to exceed the fuel value limit.

Figure 4:
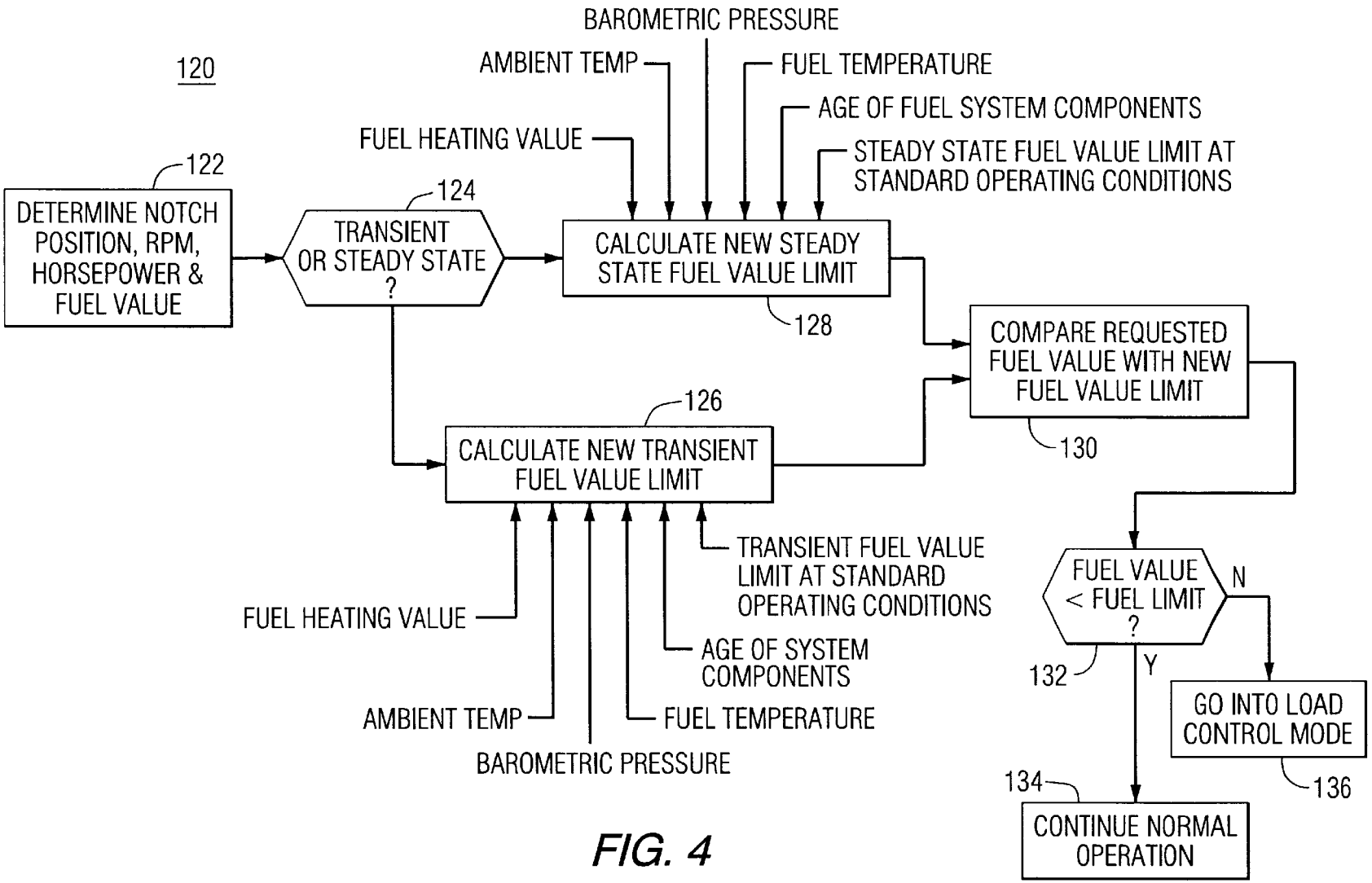
FIG. 4 is a flow chart for the process of determining the fuel value limit in accord with the teachings of the present invention.

FIG. 4 illustrates a step-by-step process 120 for controlling fuel injection and establishing a fuel valve limit as taught by the present invention. At a step 122, the process 120 determines the notch position, revolutions per minute of the engine, horsepower output from the traction alternator and the fuel value. As is known by those skilled in the art, the notch position is generally provided by the locomotive controller in the form of a 4 bit code or in other embodiments as signals on an RS-232 cable. A decision step 124 asks whether the engine is in a transient (in the process of ramping up or down to the speed and/or load of a new notch position) or in a steady state condition. Once the notch position is known, the engine condition (steady state or transient) can be determined based on the revolutions per minute and horsepower associated with the new notch position. The process of determining whether the transient or steady state condition exists is illustrated by a decision step 124. If the locomotive is in a transient condition, processing moves from the decision step 124 to a step 126 where a corrected fuel value limit is calculated. To calculate this limit, the process 120 uses as input values the fuel heating value, the ambient temperature, the barometric pressure, the fuel temperature, and the age of the fuel system components (e.g., fuel pumps and fuel injector) and the fuel value limit at standard operating conditions. Sensors for determining the temperature and pressure are discussed above. The age of the fuel injection components can be derived from knowledge of the date on which they were installed. The duration of use can then be derived from the number of locomotive operational hours from the date of installation. See also the below-mentioned commonly owned patent application. A value representative of the fuel heating value can be derived from knowledge of the heating value of the fuel in the locomotive fuel tanks. The fuel value limit under standard conditions is derived from the two-dimensional look-up table referred to above, where the engine speed (in revolutions per minute) and the manifold air density are used to find the fuel value limit in the table. This fuel value limit at standard conditions is then corrected to the current conditions to yield a corrected fuel value limit in accordance with the teachings of the present invention, as discussed in conjunction with FIG. 2.

If the locomotive is in a steady state condition, processing moves from the decision step 124 to a step 128 where a corrected steady state fuel value limit is calculated. The first step in finding the corrected fuel value limit is to determine the fuel value limit based on standard conditions. This value is derived from the one dimensional look-up table based on engine speed (as discussed above). This value is then corrected to account for the current condition to yield a corrected fuel value limit. Again, this calculation is based on the fuel heating value, ambient temperature, barometric pressure, fuel temperature, and the age of the fuel injection components, as taught by the present invention.

The following equations are used to derive the corrected fuel value limit from the standard fuel value limit in both the transient and steady state cases.

Ambient Air Temperature Correction

Corrected Fuel Limit=Standard Fuel Limit [1/(Ambient Temp*$C_1$ +$C_2$)] Where $C_1$ and $C_2$ are constants that are experimentally determined for a given engine configuration by measuring fuel value while changing the intake air temperature from a predetermined reference.

Barometric Pressure Correction

Corrected Fuel Limit=Standard Fuel Limit [(Barometric Pressure/$BP_0$)$^A$] Where $BP_0$ is the predetermined reference barometric pressure. A is a constant that is experimentally determined for a given engine configuration by measuring fuel value while at different barometric pressures.

Fuel Temperature Correction

Corrected Fuel Limit=Standard Fuel Limit [(1−$C_3$ ($T_{fo}$−Fuel Temperature)] Where $T_{fo}$ is the predetermined reference temperature. $C_3$ is a constant that is experimentally determined for a given engine configuration by measuring fuel value while at various inlet fuel temperatures.

Fuel Heating Value Correction

Corrected Fuel Limit=Standard Fuel Limit [$HHV_0$/HHV] Where $HHV_0$ is the predetermined reference higher heating value for the fuel and HHV is the actual higher heating value of the fuel.

Injection Pump Wear Correction

Corrected Fuel Limit=Standard Fuel Limit/[1+$C_4$ (MWhrs−$MWhrs_0$)] Where $MWhrs_0$ is the engine MWhrs when the injection pumps were installed. $C_4$ is a constant that is experimentally determined for a given engine configuration by measuring fuel value with pumps of various ages.

Injector Wear Correction

Corrected Fuel Limit=Standard Fuel Limit*[1+$C_5$ (MWhrs−$MWhrs_0$)] Where $MWhrs_0$ is the engine MWhrs when the injectors were installed. $C_5$ is a constant that is experimentally determined for a given engine configuration by measuring fuel value with injectors of various ages.

After the corrected fuel value limit is calculated at either of the steps 126 or 128, processing moves to a step 130 where the fuel value requested is compared with the corrected fuel value limit. Processing moves from the step 130 to a decision step 132 where a determination is made whether the fuel value is less than the corrected fuel value limit. If the fuel value is less than the corrected fuel value limit, normal operation continues, as shown at a step 134. If the fuel value exceeds the corrected fuel value limit, then the engine must go into a load control or derated mode, as illustrated by the step 136.

With regards to injector and pump age and wear, and its effect on the fuel value, see the commonly-owned patent entitled "A Method and System for Predictably Assessing Performance of a Fuel Pump in a Locomotive", U.S. Pat. No. 6,286,479. The disclosure of this patent application is hereby incorporated by reference. This patent application discusses a means for determining pump and injector age and wear, which can be beneficially used by the teachings of the present invention to determine the fuel value limit, by providing a value representative of fuel value wear to the steps 126 and 128 of FIG. 4.

While the invention has been described with reference to a preferred embodiment, it will be understood by those skilled in the art that various changes may be made and equivalent elements may be substituted for elements thereof without departing from the scope of the invention. In addition, modifications may be made to adapt a particular situation more material to the teachings of the invention without departing from the essential scope thereof. For example, the present invention may not be limited to diesel engines for locomotives, since other types of engines used for automotive, marine or other applications can equally benefit from the teachings of the present invention. Therefore, it is intended that the invention not be limited to the particular embodiment disclosed as the best mode contemplated for carrying out this invention, but that the invention will include all embodiments falling within the scope of the appended claims.

What is claimed is:

1. An internal combustion engine, comprising:

a cylinder including a combustion space;

a fuel system for injecting a fuel value into said combustion space in response to the engine load;

a controller for determining a fuel value limit for the cylinder in response to one or more engine operating conditions; and wherein said controller controls the fuel system to inject a fuel value that does not exceed said fuel value limit.

2. The internal combustion engine of claim 1 wherein the fuel value limit is determined based on one or more conditions that affect the energy output derivable from a specified fuel value.

3. An internal combustion engine, comprising:

a cylinder including a combustion space;

an intake manifold from which air is drawn into said combustion space during operation of the engine;

a throttle for controlling the engine;

in response to said throttle, a fuel system for injecting fuel into said combustion space;

a monitor for determining at least one operating condition of said engine; and a controller responsive to the at least one operating condition for limiting the fuel injected into said combustion space to a fuel quantity based on the at least one operating condition and the structural limitations of the engine.

4. The internal combustion engine of claim 3 wherein the at least one operating condition is ambient temperature.

5. The internal combustion engine of claim 3 wherein the at least one operating condition is ambient pressure.

6. The internal combustion engine of claim 3 wherein the at least one operating condition is fuel temperature.

7. The internal combustion engine of claim 3 wherein the at least one operating condition is fuel heating value.

8. The internal combustion engine of claim 3 wherein the fuel system includes a fuel pump and a fuel injector, wherein the at least one operating condition is the fuel pump wear.

9. The internal combustion engine of claim 8 wherein the at least one operating condition is fuel injector wear.

10. The internal combustion engine of claim 9 wherein the internal combustion engine comprises a multi-cylinder engine having a respective fuel system coupled to a respective one of the cylinders of said multi-cylinder engine.

11. The internal combustion engine of claim 3 wherein the maximum quantity of fuel is determined based on the at least one operating condition plus a predetermined margin value.

12. An internal combustion engine, comprising:

a cylinder including a combustion space;

an intake manifold from which air is drawn into said combustion space during operation of the engine;

a fuel system for injecting a fuel value into said combustion space, wherein the fuel value is responsive to the engine load;

a controller for determining a fuel value limit in response to one or more first predetermined operating conditions; said controller for determining a corrected fuel value limit in response to one or more second predetermined operating conditions, wherein said corrected fuel value limit is provided as an input to said fuel system, such that the fuel value injected into said combustion space does not exceed the corrected fuel value limit.

13. The internal combustion engine of claim 12 wherein the second predetermined operating conditions are selected from a group consisting of ambient temperature, ambient pressure, fuel temperature, fuel heating value, fuel pump wear, fuel injector wear, and individual locomotive variation.

14. The internal combustion engine of claim 12 comprising:

a monitor for determining the fuel value;

a comparator for comparing the fuel value and the corrected fuel value limit;

wherein the controller is responsive to said comparator for placing the internal combustion into a load control mode when the fuel value demanded exceeds the corrected fuel value limit plus a predetermined margin; and wherein said fuel system injects the fuel value when the fuel value does not exceed the corrected fuel value limit plus said predetermined margin.

15. The method of claim 14 wherein the predetermined margin is a function of one or more of the second predetermined operating conditions.

16. An article of manufacture comprising:

a computer program product comprising a computer-usable medium having a computer-readable code therein for determining the maximum fuel value to be injected into an internal combustion engine of a locomotive, wherein the engine is drivingly coupled to an alternator for providing current to one or more traction motors for moving the locomotive, wherein the locomotive further includes a manually-operated controller having a plurality of notch positions, wherein each position commands an engine speed/motor horsepower pair, and wherein a fuel injection controller is responsive to the manually-operated controller for controlling the fuel value injected into each cylinder of the internal combustion engine, said computer-readable code in the article of manufacture comprising:

a computer-readable program code module for determining the fuel value;

a computer-readable program code module for determining at least one operating or ambient condition associated with the locomotive;

a computer-readable program code module for determining whether the internal combustion engine is operating in a transient or a steady state mode;

a computer-readable program code module for determining a steady state fuel value limit based on standard operating conditions for the locomotive;

a computer-readable program code module for determining a transient fuel value limit based on standard operating conditions of the locomotive;

a computer-readable program code module for calculating a corrected steady state fuel value limit based on said at least one operating or ambient condition and the steady state fuel value limit;

a computer-readable program code module for calculating a corrected transient fuel value limit based on said at least one operating or ambient condition and the transient fuel value limit;

a computer-readable program code module for comparing said fuel value with said corrected steady state fuel value limit when the internal combustion engine is operating in the steady state mode and comparing said fuel value with said corrected transient fuel value limit when the internal combustion engine is operating in the transient mode; and a computer-readable program code module for limiting said fuel value to said corrected steady state fuel value limit when the internal combustion engine is operating in the steady state mode and limiting said fuel value to said corrected transient fuel value limit when the internal combustion engine is operating in the transient mode.

17. A method for controlling an internal combustion engine having a plurality of cylinders, wherein a fuel mass is injected into each one of the plurality of cylinders, said method comprising:

determining at least one operating or ambient condition that affects the amount of energy derivable from the fuel mass; and limiting the fuel mass that is permitted to be injected into each cylinder of the internal combustion engine in response to the at least one operating or ambient condition, such that physical damage to the internal combustion engine is avoided.

18. A method for determining a fuel value limit for an internal combustion engine of a locomotive, wherein the engine is drivingly coupled to an alternator for providing current to one or more traction motors for moving the locomotive, wherein the locomotive further includes a manually-operated controller having a plurality of notch positions, wherein each position commands an engine speed/motor horsepower pair, and wherein a fuel injection controller is responsive to the manually-operated controller for controlling a fuel value injected into each cylinder of the internal combustion engine, said method comprising:

(a) determining the fuel value in response to the manually-operated controller;

(b) determining at least one operating or ambient condition associated with the locomotive;

(c) calculating a fuel value limit based on said at least one operating or ambient condition and on the structural characteristics of the engine;

(d) comparing said fuel value with said fuel value limit; and (e) limiting said fuel value to said fuel value limit.

19. The method of claim 18 wherein the at least one operating or ambient condition is selected from a group consisting of ambient temperature, atmospheric pressure, fuel quality, fuel temperature, fuel injection pump wear, fuel injector wear, and individual locomotive variation.

20. The method of claim 18 further comprising the step of determining whether the internal combustion engine is operating in a transient or steady state condition, and wherein the step of calculating a fuel value limit calculates a first fuel value limit when the internal combustion engine is operating in a transient condition and a second fuel value limit when the internal combustion engine is operating in a steady state condition.

21. A method for determining the maximum fuel value to be injected into an internal combustion engine of a locomotive, wherein the engine is drivingly coupled to an alternator for providing current to one or more traction motors for moving the locomotive, wherein the locomotive further includes a manually-operated controller having a plurality of notch positions, wherein each position commands an engine speed/motor horsepower pair, and wherein a fuel injection, controller is responsive to the manually-operated controller for controlling the fuel value injected into each cylinder of the internal combustion engine, said method comprising:

(a) determining the fuel value;

(b) determining at least one operating or ambient condition associated with the locomotive;

(c) determining whether the internal combustion engine is operating in a transient or a steady state mode;

(d) determining a steady state fuel value limit based on standard operating conditions for the locomotive;

(e) determining a transient fuel value limit based on standard operating conditions of the locomotive;

(f) calculating a corrected steady state fuel value limit based on said at least one operating or ambient condition and the steady state fuel value limit;

(g) calculating a corrected transient fuel value limit based on said at least one operating or ambient condition and the transient fuel value limit;

(h) comparing said fuel value with said corrected steady state fuel value limit when the internal combustion engine is operating in the steady state mode and comparing said fuel value with said corrected transient fuel value limit when the internal combustion engine is operating in the transient mode; and (i) limiting said fuel value to said corrected steady state fuel value limit when the internal combustion engine is operating in the steady state mode and limiting said fuel value to said corrected transient fuel value limit when the internal combustion engine is operating in the transient mode.

22. The method of claim 21 wherein the at least one operating or ambient condition is selected from the group consisting of ambient temperature, atmospheric pressure, fuel heating value, fuel temperature, fuel injected pump wear, fuel injector wear, and individual locomotive variation.

* * * * *